United States Patent [19]

Hedstrom et al.

[11] Patent Number: 4,662,776

[45] Date of Patent: May 5, 1987

[54] LOCKING PIN SUBASSEMBLY FOR SLIDING UNITS OF CABINETS

[75] Inventors: Norman A. Hedstrom, Worcester; Bernard T. Cournoyer, Holden, both of Mass.

[73] Assignee: Wright Line, Inc., Worcester, Mass.

[21] Appl. No.: 864,583

[22] Filed: May 16, 1986

[51] Int. Cl.[4] ..... B25G 3/36

[52] U.S. Cl. ..... 403/387; 403/348

[58] Field of Search ..... 403/387, 388, 348

[56] References Cited

U.S. PATENT DOCUMENTS 3,404,929 10/1968 Wright et al. ..... 312/216

3,866,993 2/1975 Dean et al. ..... 312/216

FOREIGN PATENT DOCUMENTS 1404101 5/1965 France ..... 403/388

2455202 12/1980 France ..... 403/388

*Primary Examiner*—Andrew V. Kundrat

*Attorney, Agent, or Firm*—Hamilton, Brook, Smith and Reynolds

[57] ABSTRACT

There is disclosed a locking pin subassembly (94) for pull out components of storage cabinets having a locking bar (86) of C-shaped configuration, a locking pin (115) projecting from a threaded stud which is engagable in a threaded nut (127). The nut is the shape of a parallelogram, the nut has two pairs of projections (133*a* and 133*b*) engagable with interior surfaces of the flanges (92) of the locking bar so that when the lock pin is threaded into the nut, the nut will be drawn toward the rear surfaces of the flanges with the projections engaging the rear faces of the flanges affording antirotational and antisliding contact.

3 Claims, 5 Drawing Figures

LOCKING PIN SUBASSEMBLY FOR SLIDING UNITS OF CABINETS

FIELD OF THE INVENTION

The invention relates to storage cabinets in general and, more particularly, to mechanism for interlocking and ganglocking pull out components, such as drawers or shelves of storage cabinets, so that when one drawer or shelf is pulled out the remainder are prevented from doing so.

BACKGROUND OF THE INVENTION

In storage cabinets, which have sliding pull out components, such as shelves or drawers, it is a standard practice to employ interlocking mechanism which permits only one shelf at a time to be pulled out to prevent the cabinet from tipping over should more than one drawer or shelf be withdrawn. Because of their functional similarity with respect to this invention, drawers and pull out shelves will be referred to interchangeably and generically as pull-out components.

It will be appreciated that while this invention is illustrated as embodied in an interlock mechanism to permit only one shelf at a time to be withdrawn, the principles and features may be employed in ganglock mechanism where all pull out components are simultaneously locked and prevented from being pulled out.

One such interlocking mechanism is disclosed in U.S. Pat. No. 3,404,929 which issued in 1968 to David M. Wright et al. The mechanism employs a vertically, slidable locking bar that bridges a number of shelves or drawers and which cooperates with cam mechanism on each component to prevent them from being withdrawn after one component has been withdrawn. Each component has an identical cam assembly secured to it and the locking bar has one locking pin fixed to it for each cam, and hence, each component. The cam assembly of each component is positioned to engage one pin when the component is pulled out. The cam, in engaging the pin, urges it and the locking bar, upwardly to locate the remaining pins in positions where they block the removal of the remaining components. The locking bar and the pins fixed to it, remain in the upward or locking position until the original component is returned to its closed position. At this time, the cam associated with the returned drawer permits its associated pin and thus the locking bar to move downwardly, thus, positioning all of the pins relative to their respective cams in positions where any other component may be withdrawn from or slid out of the cabinet. This mechanism proved to be quite successful commercially.

Subsequently, U.S. Pat. No. 3,866,993 issued in 1975 to Carl J. Dean et al. which was an improvement on the above-identified Wright et al. patent. It had been determined that there was a need for storage cabinets having either different height drawers or drawers which were interchangeable. To accomplish this, it was necessary that a custom made interlock mechanism be provided for each different combination of pull-out component, for example, a combination of deep drawers at the bottom, pull-out shelves, smaller drawers above it, etc. It was also determined that many users, having different requirements, from time to time rearranged and interchanged their pull-out components. An interlock system designed for an original arrangement of components had to be discarded when the pull-out components were rearranged. The '993 patent also disclosed an interlock mechanism which had a vertically movable locking bar positioned along one side of a storage cabinet which bridged a plurality of pull-out components with cam mechanism positioned on each of the components and a locking pin subassembly associated with each cam.

However, in the '993 patent, the locking pins were adjustable heightwise along the locking bar to permit them to be located to cooperate not only with cams that were positioned at different locations as, for example, on pull-out components that differed in height, but also permitted the locking pins to be repositioned if one pull-out component was replaced with another one that differed in height.

Whereas, the adjustable feature of the '993 patent proved to be more versatile than the nonadjustable interlock mechanism of the '929 patent, the mechanism for permitting heightwise adjustability of the locking pins, after repeated usage occasionally loosened and the pins became misaligned with their associated cams. Also, after repeated usage, the locking pin positioning mechanism tended to loose its holding power and required replacement.

It is accordingly an object of this invention to provide an adjustable locking pin subassembly employed in storage cabinets having pull-out storage components, which has greater holding power than heretofore and which is less susceptible to wear after lengthy periods of usage.

SUMMARY OF THE INVENTION

There is dislosed a locking pin subassembly for a ganglock or an interlock for pull out components of a storage cabinet. The subassembly includes a locking bar in the form of a C-shaped channel having a back, side walls spaced from each other, and a pair of inwardly directed flat flanges having a space between them. Each flange has a front surface and a rear surface. A lock pin projects from a threaded stud which passes through a spacer plate that has a surface engagable with the front surfaces of the flanges of the locking bar. The locking pin is threaded into a nut located within channel.

The nut is in the shape of a parallelogram having unequal sides. The length of the smaller pair of parallel sides is less than the space between the flanges to permit the nut to enter and to be removed from the channel. The length of the second, or larger pair of parallel sides, is greater than the space between the side walls of the channel so that when the lock pin is threaded into the nut, at least a portion of one of the first or smaller pair of parallel sides engages the side wall of the channel and presses against it.

The threaded nut has two pairs of projections engagable with the rear surface of the flanges of the locking bar so that when the lock pin is threaded into the nut, the nut is drawn toward the rear surfaces of the flanges with the projections engaging them and affording antirotational and antisliding contact. The projections on the nut are arranged in a parallelogram configuration and the distance between the projections on the nut and the parallel edges of the nut is less than the width of the flanges in the channel so that the projections will always be seated against the back walls of the flanges.

The spacer plate, through which the lock pin passes, has two pair of projections arranged in a rectangle on the surface of the plate which is engagable with the flanges of the locking bar. The lateral distance between the projections is slightly less than the space between the flanges to permit the projections to enter the channel to guide the plate and prevent its rotation relative to the channel. One of the pairs of projections on the spacer plate is formed along an upper edge of the plate.

The above and other features of the invention including various novel details of construction and combinations of parts will now be more particularly described with reference to the accompanying drawings and pointed out in the claims. It will be understood that the particular locking pin subassembly embodying the invention is shown by way of illustration only and not as a limitation of the invention. The principles and features of this invention may be employed in varied and numerous embodiments without departing from the scope of the invention. For example, it may be employed in a ganglock subassembly.

DETAILED DESCRIPTION OF THE INVENTION

Figure 1:
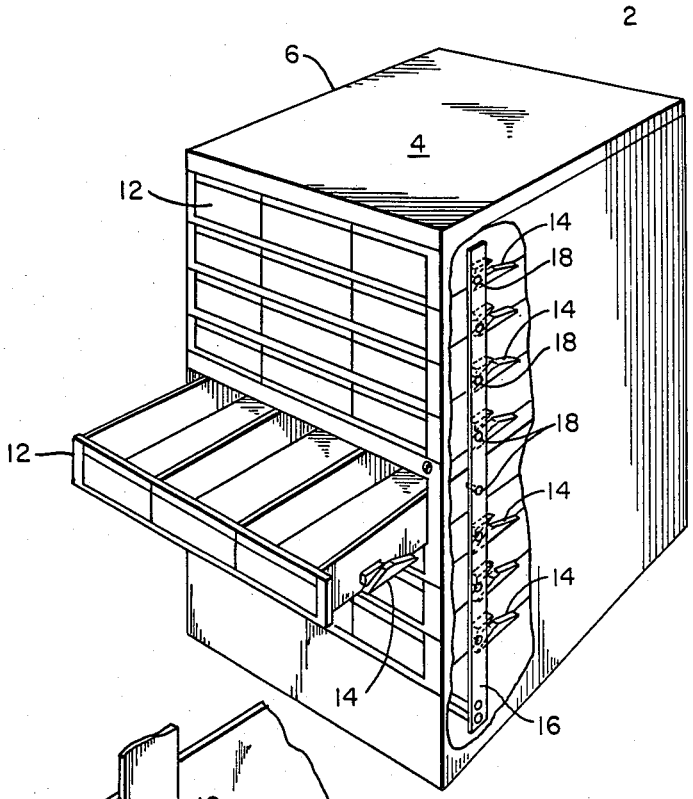
FIG. 1 is a perspective view, partially broken away for clarity, of a multidrawer file system including an interlocking mechanism representing the prior art.

FIG. 1 shows an illustrative file cabinet 2 which incorporates an interlocking system made in accordance with the prior art but to which interlocking system, in general, the present invention is applicable. The cabinet includes eight multicomponent drawers 12 of equal size and shape. It will be understood that the present invention, while applicable to a cabinet having drawers of equal size as shown in FIG. 1, is primarily intended for a cabinet having pull-out components of drawers or shelves which are not uniform or where such pull-out components may be intercharged heightwise relative to each other.

Figure 2:
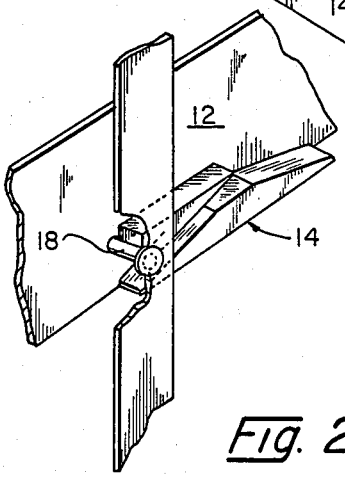
FIG. 2 is an exploded perspective view, partially broken away, showing the cam mechanism, the locking bar, and a locking pin of the file system of FIG. 1.

Each of the drawers 12 is provided with cam mechanism 14 and a vertically movable locking bar 16. The bar is provided with one locking pin 18 for each drawer which cooperates with the cam mechanism 14 of a particular drawer. The pins 18 are permanently fixed in heightwise locations to cooperate with the cam mechanism on each drawer. A more detailed description of the operation of the interlocking mechanism shown in FIGS. 1 and 2 will be found in U.S. Pat. No. 3,404,929, which is incorporated herein by reference.

Figure 3:
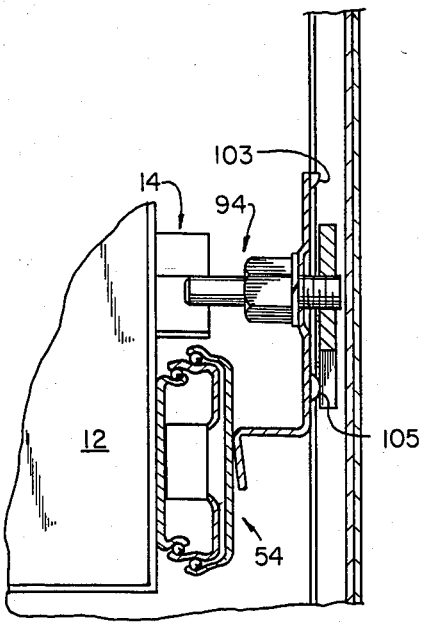
FIG. 3 is a detailed view, partly in section, of an adjustable, locking pin subassembly made in accordance with the present invention.
Figure 4:
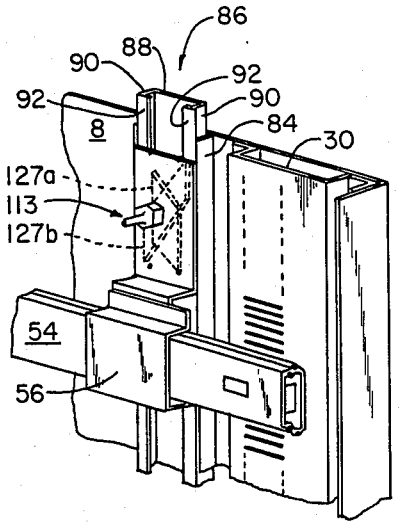
FIG. 4 is an enlarged perspective view of the adjustable, locking pin subassembly of FIG. 3.

It is this mechanism as well as the mechanism subsequently disclosed in U.S. Pat. No. 3,866,993, which is also incorporated by reference, which the present invention improves upon. As seen in FIGS. 3 and 4, one side wall 8 and a portion of a drawer or other pull-out component 12 is shown. There are uprights 30 secured to each of the side walls 6 and 8 of the cabinet although only upright 30 is shown. The uprights are provided with a series of vertically spaced horizontally elongated slots in which suspensions for pull-out components, such as the drawer 12, may be located. The suspension system of each pull-out component or drawer may be selectively positioned heightwise in any combination of slots. The suspension system indicated only fragmentally in FIG. 4, includes a suspension arm 54 and a gauge template 56 in the same manner as that of the Dean et al. patent.

The interlock mechanism includes a vertically extending, U-shaped open vertical guide 84. It is secured to the side panel 8 of the cabinet. Slidable in an open vertical guide 84 is a channel member 86 which is actually the locking bar and is in the form of a flat, C-shaped channel member. The locking bar 86 includes a flat body portion 88 and parallel flat opposite side walls 90 that extend at right angles to the body portion 88. The side walls 90 have integral right angle flanges 92. The locking bar 86 and its guide 84 are of a size so that the bar 86 forms a sliding fit with the guide 84. The front surfaces of the flanges 92 are at least flush and preferably project beyond the front edges of the sides of the guide 84. The locking bar is retained in the guide 84 by any convenient means (not shown) and not forming a part of the present invention.

Figure 5:
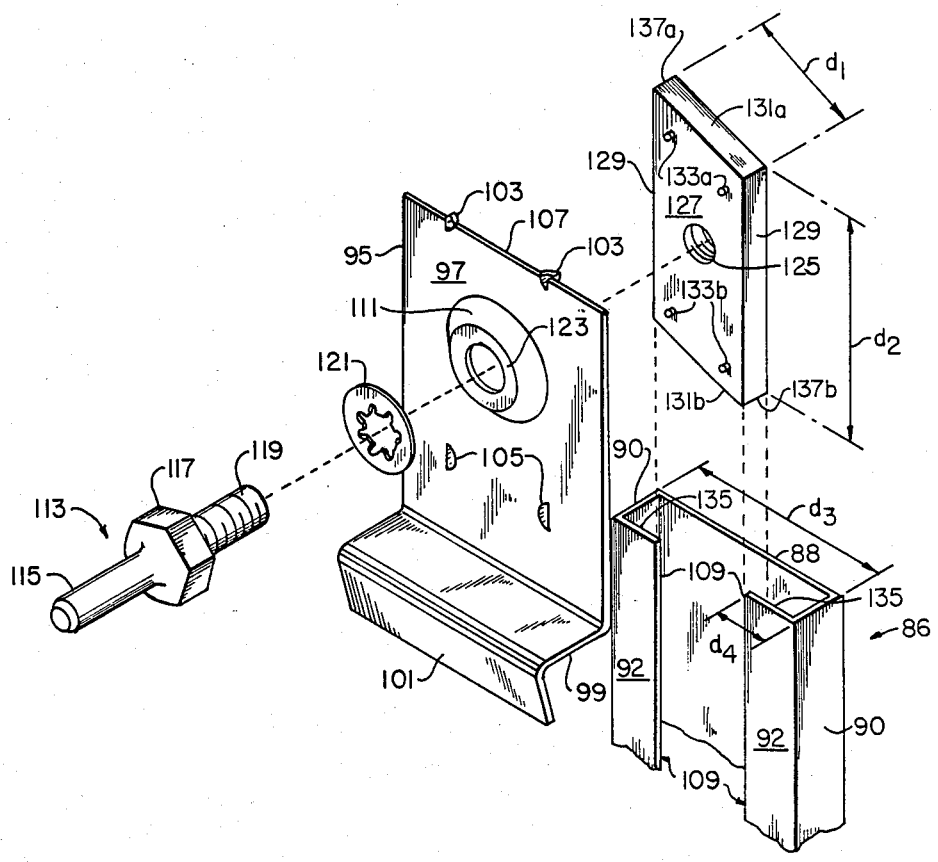
FIG. 5 is an exploded perspective view of the locking pin subassembly made in accordance with the present invention.

The locking bar carries a plurality of locking pin subassemblies 94 (FIG. 3), one subassembly being provided for each pull-out component. Referring to FIG. 5, the subassembly 94 is shown in exploded perspective view and includes a spacer plate 95 which has a flat, substantially rectangular portion 97, an offset portion 99, and an inclined flange 101 extending downwardly from the offset portion. Guide projections 103, 105 are formed on the body portion 97 of the spacer plate. The projections 103 are located at the top edge 107 of the spacer plate and the projections 105 extend through the plate and project from the back surface thereof vertically beneath the projections 103. The projections 103, 105 form the corners of a rectangle. The projections may be stamped out of the plate or secured to the rear face thereof. The lateral spacing between projections 103 and 105 is slightly less than the lateral spacing between the flanges 92 of the locking bar 86. The rear surface of the spacer plate 95 fits flush against the forward facing surface 92 of the locking bar 86 with the projections 103 and 105 lying inwardly of the vertical edges 109 of the flanges 92 so that the plate may be moved up and down relative to the channel 86 without pivoting relative thereto.

A boss 111 is formed on the spacer plate equidistant between its edges. It projects forwardly as viewed in FIG. 5 whereas the guide projections 103, 105 face rearwardly.

The locking pin subassembly 94 includes a lock pin or stud 113 having a cylindrical projection 115 which is engagable with the cam 14 on a pull-out assembly such as a drawer 12. Contiguous with the cylindrical portion 115 is a hex nut 117 and a threaded cylindrical portion 119. The threaded portion 119 passes through a lock washer 121 which engages the back face of the hex nut 117 and, when assembled, through the boss 111, engaging a flat circular portion 123 on the boss 111.

The threaded portion 119 of the locking pin assembly, is received within a threaded bore 125 in a locking nut 127. The nut is formed in the shape of parallelogram of unequal sides: first, large parallel sides 129 and second smaller parallel sides 131*a* and 131*b*. The distance $d_1$ between the sides 129 is less than the distance between the flanges 92 on the lock bar 86 whereby the nut 127 may be inserted between the flanges of the plate.

The thickness of the locking plate 127 is less than the distance from the flanges 92 to the rear wall 88 of the lock bar 86. The distance $d_2$ between the sides 131 is greater than the distance $d_1$ and hence greater than the space between the flanges 92. However, the distance $d_2$ is greater than the distance $d_3$ which is the internal dimension between the walls 90 in the lock bar 86.

Projections 133 are formed on the front face of the locking nut 127 near the corners of the parallelogram formed by the intersecting sides 129 and 131. The centers of the projections 133 are also positioned as the corners of a parallelogram of smaller size than that described by the plate 127. The projections 133 may be formed either by striking the nut 127 from the rear in a die, machining the nut 127 to permit the projections to extend outwardly of the surface of the nut or may be pins firmly secured in the nut. It will be noted that the projections 133*a* lie on a line which is parallel to the upper side 131*a* of the parallelogram and that the projections 133*b* lie on a line which is parallel to the lower side 131*b* of the parallelogram plate.

The locking pin assembly is inserted into the lock bar 86 by passing stud 119 through the lock washer 121 and through the boss 111. It is threaded partially into the parallelogram locking nut 127. The nut 127 is held in the dotted vertical position as shown in FIG. 5 and the spacer plate 95 is then moved into engagement with the front faces of the flanges 92 with the guide members 103, 105 engaging the inner edges of the flanges 92. The parallelogram locking nut passes between the flanges 92 into the lock bar 86.

The locking nut in the assembly operation is shown in the dotted line position 127*a* in FIG. 4. After the nut enters the lock bar 86, the hex nut 127 is turned clockwise to draw the nut toward the rear walls 135 of the lock bar 86, with the parallelogram locking plate initially rotating to the position designated in FIG. 3 as 127*b*. Since the distance $d_2$ is greater than the distance $d_3$, the locking nut 127 will rotate clockwise slightly until a corner of one of the edges 131*a* or 131*b* engages an inner side of a wall 90. Continued tightening of the hex portion 117 will cause at least one of the acute corners of the parallelogram to forceably engage the wall 90. Whereas, the projections 133*a* and 133*b* are shown parallel to the edges 131*a* and 131*b*, they need not necessarily be so. The only requirement being that the minimum distance between the projections 133*a* and the side 131*a*, as well as the minimum distance between the projections 133*b* and the edge 131*b*, be less than the distance $d_4$ which is the interior extent of the flange 92. This is to assure that the projections 133*a* and 133*b* always maintain contact with the inner surface of the flanges 92. Upon fully tightening the hex nut 117, the projections 133 afford antirotational and antisliding engagement between the locking pin 113 and the lock bar 86.

By reversing the above-described process, the lock pin 113 may be re-adjusted and repositioned heightwise of the lock bar.

We claim:

1. A locking pin subassembly for pull-out components of a storage cabinet comprising:

a locking bar having a C-shaped channel having a back, side walls spaced from each other and inwardly directed flat flanges having a space between them, each flange having a front surface and a rear surface, a lock pin projecting from a threaded stud which passes through a spacer plate having a surface which is engagable with the front surfaces of the flanges of the locking bar, a threaded nut in the shape of a parallelogram in the channel, the threaded nut having two pair of projections engagable with the rear surface of the flanges of the locking bar so that when the lock pin is threaded into the nut, the nut will be drawn toward the rear surface of the flanges with the projections engaging the flanges and affording antirotational and antisliding control.

2. A subassembly according to claim 1 wherein the two pair of projections on the nut are arranged in a parallelogram configuration.

3. A subassembly according to claim 1 wherein the distance between the projections on the nut and the edges of the nut is less than the width of the flanges of the channel.

* * * * *